United States Patent [19]

Higuchi et al.

[11] Patent Number: 5,027,029

[45] Date of Patent: Jun. 25, 1991

[54] INDIRECTLY HEATED CATHODE ASSEMBLY AND ITS ASSOCIATED ELECTRON GUN STRUCTURE

[75] Inventors: Toshiharu Higuchi, Yokohama; Sadao Matsumoto, Sagamihara; Toru Yakabe, Yokosuka; Sakae Kimura, Tokyo, all of Japan

[73] Assignee: Kabushiki Kaisha Toshiba, Kawasaki, Japan

[21] Appl. No.: 447,904

[22] Filed: Dec. 8, 1989

[30] Foreign Application Priority Data

Dec. 16, 1988 [JP] Japan ..... 63-318238

[51] Int. Cl.[5] ..... H01J 29/48

[52] U.S. Cl. ..... 313/446; 313/340; 313/346 DC; 313/37; 313/337

[58] Field of Search ..... 313/446, 451, 340, 346 DC, 313/337, 37, 38

[56] References Cited

U.S. PATENT DOCUMENTS

| | | | |
|---|---|---|---|
| 3,626,231 | 12/1971 | Khal | 313/37 |
| 3,681,643 | 1/1972 | Blatter | 313/337 |
| 4,101,801 | 7/1978 | Collins | 313/451 X |
| 4,313,854 | 2/1982 | Sunahara | 313/346 R X |
| 4,820,954 | 4/1989 | Kimura et al. | 313/270 |

FOREIGN PATENT DOCUMENTS

| | | |
|---|---|---|
| 0022201 | 1/1981 | European Pat. Off. . |
| 57-26514 | 6/1982 | Japan . |
| 59-33146 | 9/1984 | Japan . |
| 2074783 | 4/1981 | United Kingdom . |

OTHER PUBLICATIONS

Patent Abstracts of Japan, vol. 6, No. 81 (E-107)(959) May 19, 1982.

*Primary Examiner*—Sandra L. O'Shea
*Assistant Examiner*—N. D. Patel
*Attorney, Agent, or Firm*—Cushman, Darby & Cushman

[57] ABSTRACT

An indirectly heated type cathode assembly comprises a cathode sleeve having a heater within itself and having an emitter-impregnated type cathode disc fitted at one end, a plurality of straps connected at one end to a lower end portion of the cathode sleeve, and a cylinder holder whose upper end is connected to the other end of each strap, the holder being located outside the cathode sleeve such that it is spaced a predetermined distance apart from the cathode sleeve. A heat reflecting cylinder is located between the cathode sleeve and the holder of the indirectly heated type cathode assembly such that it is coaxial with the cathode sleeve and holder. The heat reflecting cylinder is supported by the holder and each strap extends such that it is not in contact with the heat reflecting cylinder. The strap is made of a Ta-W alloy or a Ta-W-Hf alloy. An electron gun structure comprises the indirectly heated type cathode assembly, a first grid placed in front of the indirectly heated type cathode assembly and an insulation support into which the first grid and the holder of the indirectly heated type cathode assembly are embedded partially and directly through a securing piece, respectively. The cathode disc is hidden, by a heat reflecting cylinder, from view at least that portion of the insulating support which is defined between an embedded spot of the first grid and that of the securing piece.

7 Claims, 3 Drawing Sheets

INDIRECTLY HEATED CATHODE ASSEMBLY AND ITS ASSOCIATED ELECTRON GUN STRUCTURE

BACKGROUND OF THE INVENTION

1. Field of the Invention

The present invention relates to an electric-power saving type high-performance, indirectly-heated cathode assembly for use, for example, in a color CRT (cathode ray tube) and its associated electron gun tube structure.

2. Description of the Related Art

Recently, there is a growing demand for a color CRT of an improved resolution with added scanning lines, an ultrahigh frequency-responsive picture tube and so on. A demand is also made for improved brightness, for example, in a projection CRT. In order to meet these demands, the density of emission electron from the cathode need to be increased to a greater extent.

An emitter-impregnated type cathode can obtain a greater current density than an oxide cathode. For this reason, the emitter-impregnated type cathode has been employed for a pickup tube, travelling-wave tube, Klystron and so on. In the field of color CRTs, however, the emitter-impregnated type cathode finds only a limited application.

The emitter-impregnated cathode of indirectly heated cathode assembly is constructed, such a type as shown in FIG. 1. In the structure shown in FIG. 1, a heater 1 is located within a cathode sleeve 2. A cap 4 is fitted into one end of the cathode sleeve 2 and has an emitter-impregnated cathode disc 3. A cylindrical holder 6 is disposed outside the cathode sleeve 2 such that it is situated coaxial with the cathode sleeve 2. The cathode sleeve 2 is fixedly supported by three straps 5 made of tantalum.

The operation temperature of the aforementioned indirectly heated cathode assembly is higher than that of the oxide cathode type by about 200° C. Thus the indirectly heated cathode assembly requires more heater's electric power, presenting a bar to its practical application.

For economy in the electric power of the indirectly heated cathode assembly, it is necessary that it be made compact. In order to obtain a compact unit, it will be proved effective to reduce the cross-sectional area of the strap and the heat conduction loss.

However, the straps are so employed as to support the cathode and, if made too small, will be deformed at the operation of the cathode due to a fatigue resulting from heat. As a result, the characteristics of the color CRT become defective, such as degraded brightness or color drift.

Japanese Utility Model Publication (KOKOKU) 59-33146 discloses a heat reflective means which is provided outside straps. In the structure of KOKOKU, the means is placed outside of straps and thermally contacted with straps, failing to achieve a saving in electric power and a compactness.

The Japanese Utility Model Publication (KOKOKU) 57-26514 also discloses a heat reflecting cylinder which is located between a sleeve and straps and fixed to the sleeve. Since, however, the heat reflecting cylinder is placed in direct contact with the sleeve, heat is dissipated through the sleeve during operation, failing to achieve a saving in electric power.

SUMMARY OF THE INVENTION

It is accordingly the object of the present invention to provide an indirectly heated cathode assembly of better thermal efficiency and its associated electron gun structure which can suppress a heater's electric power.

The indirectly heated cathode assembly of the present invention is of such a type that a heat reflecting cylinder is located between a cathode sleeve and a holder and fixed to the holder. Furthermore, straps have both ends attached to the corresponding lower end portion of the cathode sleeve and corresponding upper end portion of the holder and are thermally insulated from the heat reflecting cylinder.

Furthermore, the indirectly heated type cathode assembly according to the present invention is of such a type that the straps are made of a Ta-W alloy or a Ta-W-Hf alloy.

An electron gun structure according to the present invention is such that a first grid is located in front of the indirectly heated type cathode assembly. The first grid and the holder of the indirectly heated type cathode assembly are embedded partially and directly through a securing piece, respectively. The cathode disc is hidden, by the heat reflecting cylinder, from view at least that portion of an insulation support which is defined between an embedded spot of the first grid and that of the securing piece.

DETAILED DESCRIPTION OF THE PREFERRED EMBODIMENTS

Figure 2:
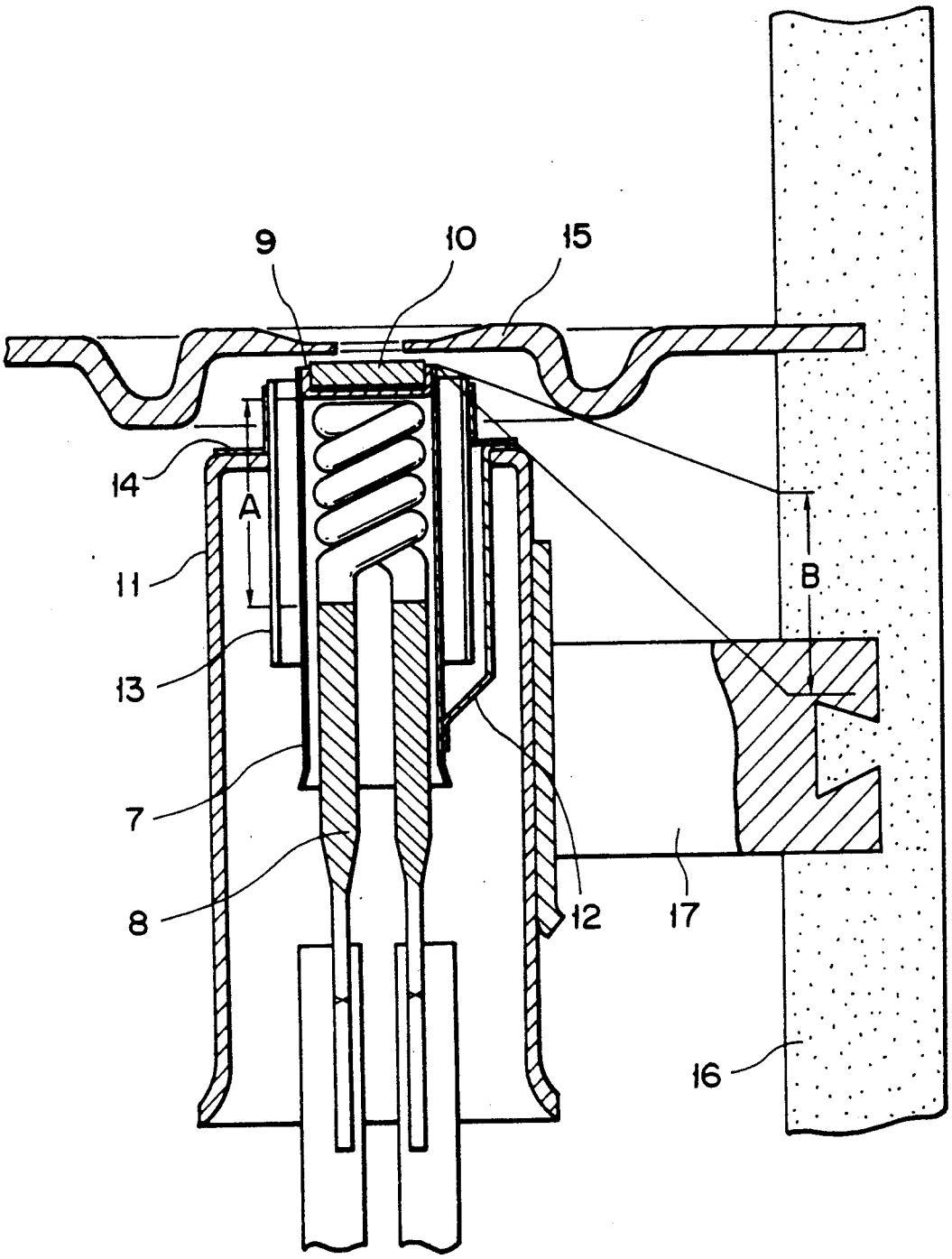
FIG. 2 is a cross-sectional view showing an indirectly heated type cathode assembly according to one embodiment of the present invention.

An indirectly heated type cathode assembly and its associated electron gun structure according to one embodiment of the present invention are shown in FIG. 2.

In FIG. 2, reference numeral 7 shows a cathode sleeve made of tantalum. A heater 8 is provided within the cathode sleeve 7 and is of a coiled-coil type. A primary coil at an area A in FIG. 2 is wound at a finer pitch on the heater portion than the rest of the heater. In this embodiment, the area A is wound at a rate of the pitch about ⅓ that of the rest of the heater.

A cup 9 which is made of tantalum is fitted into an open upper end of the cathode sleeve 7. An emitter-impregnated type cathode disc 10 is fitted into the cup 9 and obtained by impregnating a porous tungsten (W) substrate of about 20% in porosity with an electron emissive material. An iridium (Ir)-tungsten (W) alloy layer is formed on the surface of the cathode disc 10.

The insulation degradation of the heater 8 occurs due to the scattering of vapor-phase deposits of the emitter material, such as Ba, from the cathode disc 10 toward the heater 8. In order to prevent such scattering, the cup 9 is fitted into the open upper end of the cathode sleeve 7.

Outside the cathode sleeve 7, a cylindrical holder 11 is provided coaxial with the cathode sleeve 7 such that it is spaced a predetermined distance apart from the cathode sleeve 7. The cathode sleeve 7 is supported by the holder 11 through a plurality of strip-like straps 12, for example, three straps. In this case, the strap 12 is connected at one end to the lower end portion of the cathode sleeve 7 and at the other end to the upper end of the holder 11.

From the result of tests it has been found that the strap 12, if being made of, for example, a Ta-10%W alloy, Ta-3%W alloy, Ta-8%W-2%Hf alloy or Ta-10%W-2.5%Hf, reveals a high heat resistance and low-heat conduction. The other characteristics as obtained as the result of the tests are as shown in Table 1 below:

TABLE 1

| Samples | Chemical Composition (Wt %) Ta | W | Hf | Cutoff Voltage Variation (V) | Workability |
|---|---|---|---|---|---|
| Conventional Assembly | 100 | — | — | 3.0 | good |
| Sample 1 | Bal | 2.5 | — | 1.5 | " |
| Sample 2 | Bal | 7.5 | — | 0.3 | " |
| Sample 3 | Bal | 10.0 | — | 0.6 | " |
| Sample 4 | Bal | 12.5 | — | 0.7 | possible |
| Sample 5 | Bal | 15.0 | — | — | difficult |
| Sample 6 | Bal | 8 | 2 | 0.6 | good |
| Sample 7 | Bal | 10 | 2.5 | 0.6 | good |
| Sample 8 | Bal | 5 | 5 | 0.5 | possible |
| Sample 9 | Bal | 3 | 7 | — | difficult |

As seen from the Table 1, 2.5 to 12.5% of W in Ta or 2 to 5% of Hf in Ta in the chemical compositions of the samples are preferable, all of which are percent by weight. Between the cathode sleeve 7 and the holder 11, a heat reflecting cylinder 13 is located coaxial with the cathode sleeve 7 and holder 11 and supported relative to the upper end of the holder 11 by a plurality of support members such as support pieces 14. The support pieces 14 are L-shaped in cross-section.

As the support member, use may be made of not only the support pieces 14 but also an annular support member. Or it may be possible to strike a portion of the heat reflecting cylinder, as a struck-out portion, out of itself or upset the heat reflecting cylinder by a press to provide a flange portion.

As seen from FIG. 2, the strap 12 for supporting the cathode sleeve 7 is located such that it is not in contact with the heat reflecting cylinder 13. That is, the strap 12 extends below the heat reflecting cylinder 13 with a major portion parallel to the axis of the cylinder 13, and is welded to the upper end of the holder 11.

A first grid 15 is located in front of the indirectly-heated cathode assembly thus configured, so that it is spaced a predetermined distance apart from the cathode assembly. The peripheral portion of the first grid 15 is embedded in an insulation support 16 made of glass. One end of the fixing or securing piece 17 is mounted on the outer peripheral portion of the holder 11. The other end of the securing piece 17 is embedded into the insulation support 16.

In this case, the cathode disc 10 is hidden, by the heat reflecting cylinder 13, from view at at least that portion (a portion indicated by B in FIG. 2) of the insulation support which is defined between the embedded spot of the first grid 15 and that of the securing piece 17.

As a result, the heat reflecting cylinder 13 is provided between the cathode sleeve 7 and the holder 11 to shield vapor deposits of the emitter material coming from the cathode disc 10. By so doing, it is possible to prevent vapor deposition of the emitter material on the insulation support and stem section of electron guns. This improves the withstand voltage characteristic and stray emission characteristic of a color CRT.

The indirectly-heated type cathode assembly according to this embodiment has the heat reflecting cylinder 13 and employs a low heat conduction material for the strap 12. Furthermore, the heater 8 is of a variable pitch type and hence provides an electric power-saving structure.

Figure 1:
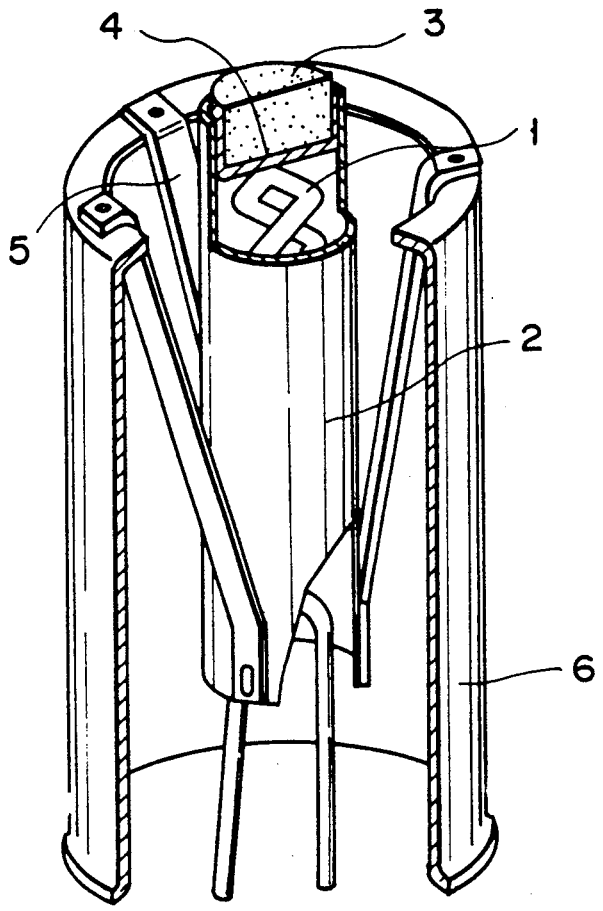
FIG. 1 PRIOR ART
FIG. 1 is a perspective view, partly cut away, showing a conventional, indirectly heated type cathode assembly.

By so doing, the dissipation power has only to be about one-third that of the conventional assembly shown in FIG. 1, noting that the power dissipation of the invention assembly is 0.7 W and the power dissipation of the conventional assembly is 2 W. Therefore, the indirectly heated cathode assembly of the present invention can be mounted on an oxide cathode-incorporated CRT without the need of altering an associated circuit.

The result of an electric power saving leads to a lowering in heater temperature and an improved heater-to-sleeve withstand voltage characteristic, noting that, under an artificially harsh test, conventional assembly could perform up to 600 V but the present invention could perform up to 1200 V.

According to the present invention, the cathode degradation resulting from ion impact can be prevented during the manufacture of a color CRT. That is, at the exhaust and high-voltage aging steps of the color CRT, discharge occurs across the first grid 15 and the cathode disc 10. Due to such discharge, the cathode is subject to ion impact, causing defective emission.

In this embodiment, however, owing to the presence of the heat reflecting cylinder, discharge is produced across the forward end of the heat reflecting cylinder 13 and the first grid 15, causing no loss in the cathode disc 10.

According to the present invention, since the material for the strap allows an improved heat resistance, it is possible to improve, for example, the degraded brightness and color drift of the color CRT.

That is, a change in the dimension of Ggl-K (a gap between the first grid and the cathode surface), if being caused for some reason or other, results in a change in the cutoff voltage and hence a change in the anode current.

For the color CRT, the cutoff voltage of the red, green and blue electron guns is so controlled as to develop predetermined color.

However, the prolonged use of the color CRT causes the deformation of the associated component parts resulting from their fatigue by heat, thus giving rise to the dimensional change of Ggl-K. Since the dimensional change is not constant for the red, green and blue electron guns, anode current which is incident to the phosphor screen varies, thus producing a color drift and degraded brightness.

In order to evaluate a possible dimensional change for a different strap material, tests were conducted to allow the indirectly-heated type cathode assembly of FIG. 2 to cool after being heated. The tests were repetitively conducted at a cathode temperature of 1150° C. with the cathode assembly ON for five minutes and OFF for 10 minutes. The dimensional change between the cathode and the first grid is proportional to a change in the cutoff voltage and, therefore, the deformation of the strap can relatively precisely be measured by measuring the change in the cutoff voltage. In this way, measurement was made of the change in the cutoff voltage.

Figure 3:
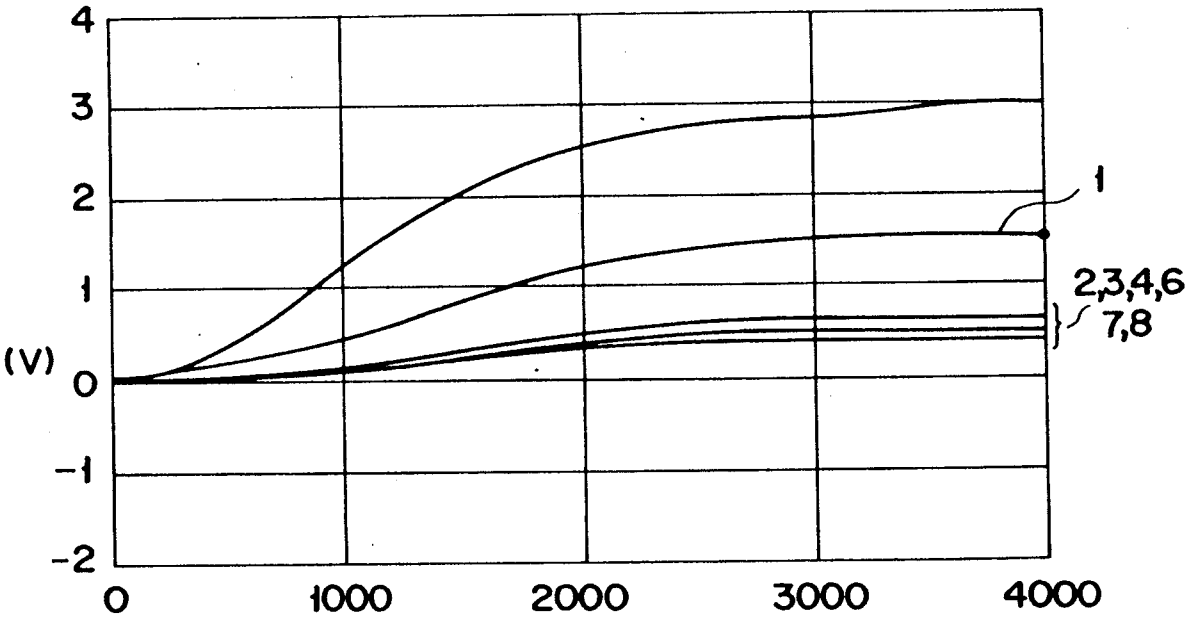
FIG. 3 shows characteristic curves representing a change in the cutoff voltage of each strap which is used in a conventional, indirectly heated type cathode assembly and an indirectly heated type cathode assembly of the present invention.

Since a slow change occurred under the normal operation temperature condition, the cathode was caused to be heated at 1150° C. and, after a stable condition was reached, allowed to cool. Such operations were repeated to examine a change in the cutoff voltage. FIG. 3 shows a change in the cutoff voltage for the case of a conventional tantalum strap and an alloy strap of the present invention, noting that the numerals in FIG. 3 correspond to those in Table 1.

As seen from FIG. 3, a change in the cutoff voltage emerges, after 1000 times ON-OFF tests, for the case of the conventional tantalum strap and almost no change in the cutoff voltage emerges over a very long period of time, for the case of the alloy strap of the present invention, in which the ON-OFF tests were conducted under the same condition.

Furthermore, the cathode was caused to be heated up to 1250° C., but a very small change in the cutoff voltage occurred. Hence the strap of the present invention revealed a very small change over a very long period even after many ON-OFF tests.

According to the present invention, the strap reveals an improved heat resistance and allows its smaller cross-section. It is thus possible to prevent deformation of the strap by heat.

That is, the conventional strap was 0.025 $mm^2$ in cross-section and the strap of the present invention can reduce its cross-section to 0.01 $mm^2$ in terms of using a heat resistant alloy, ensuring a power saving of 0.2 W (30% of full power).

As already set forth above, the indirectly-heated type cathode assembly of the present invention has the heat reflecting cylinder which is not in contact with the cathode sleeve, heat radiation near the cathode disc is suppressed, ensuring an enhanced cathode heat efficiency.

Furthermore, the heat reflecting cylinder shields a vapor-phase deposition of the emitter material from the cathode disc onto the insulation support and stem section of the electron guns, thus improving the withstand voltage characteristic and stray emission characteristic of the color CRT.

Since the strap is made of a Ta-W alloy or Ta-W-Hf alloy, it is possible to prevent heat deformation and to obtain an enhanced heat resistant unit. As a result, if the indirectly heated type cathode assembly is used for a color CRT, it is possible to prominently improve degraded brightness, color drift and the other characteristics of the color CRT. According to the present invention, it is possible to enhance the heat resistance of the strap and to obtain a compact strap and hence contribute to power economy.

The cathode disc is not restricted to the emitter-impregnated type. The heat reflecting cylinder, cathode sleeve and cylindrical holder may not necessarily be made coaxial with each other.

What is claimed is:

1. A cathode assembly for a cathode ray tube comprising:

a cathode sleeve for supporting a cathode disc emitting an electron beam, a heater disposed inside the cathode sleeve, a plurality of straps for supporting the cathode sleeve on a side opposite to that on which the cathode disc is located, a cylindrical holder for fixing the straps, a heat reflecting cylinder disposed between the cathode sleeve and the cylindrical holder and held by the cylindrical holder, and thermally insulated from the straps.

2. The cathode assembly according to claim 1, wherein the cathode disc is an emitter-impregnated type.

3. The cathode assembly according to claim 1, wherein the cylindrical holder, the cathode sleeve and the heat reflecting cylinder are located coaxial with each other.

4. The cathode assembly according to claim 1, wherein a first grid is arranged in front of the cathode assembly which is an indirectly-heated type; the first grid and the cylindrical holder of the indirectly-heated type cathode assembly are embedded into an insulation support partially and directly through a securing piece, respectively; and the cathode disc is hidden, by a heat reflecting cylinder, from view at least that portion of the insulation support which is defined between an embedded spot of the first grid and that of the securing piece.

5. The cathode assembly according to claim 1, wherein the strap is made of a Ta-W alloy or a Ta-W-Hf alloy.

6. An indirectly heated type cathode assembly comprising:

a cathode sleeve having a heater within itself and having an emitter-incorporated cathode disc fitted at one end thereof;

a plurality of straps connected at one end to a lower end portion of the cathode sleeve; and a cylindrical holder whose upper end is connected to the other end of each strap, the holder being located outside the cathode sleeve such that it is spaced a predetermined distance apart from the cathode sleeve, wherein each strap is made of analogy of a Ta-W alloy or a Ta-W-Hf alloy.

7. The indirectly heated type cathode assembly according to claim 5, wherein the strap has a composition range of 2.5 to 12.5% by weight of W in Ta or 2 to 5% by weight of Hf in Ta.

* * * * *